US008680009B2

(12) United States Patent
Sawada

(10) Patent No.: US 8,680,009 B2
(45) **Date of Patent: *Mar. 25, 2014**

(54) THERMAL TRANSFER SHEET

(75) Inventor: Masakazu Sawada, Kanagawa (JP)

(73) Assignee: Sony Corporation (JP)

( * ) Notice: Subject to any disclaimer, the term of this patent is extended or adjusted under 35 U.S.C. 154(b) by 417 days.

This patent is subject to a terminal disclaimer.

(21) Appl. No.: 12/657,813

(22) Filed: Jan. 28, 2010

(65) Prior Publication Data

US 2010/0196631 A1 Aug. 5, 2010

(30) Foreign Application Priority Data

Feb. 4, 2009 (JP) ..... P2009-023969

(51) Int. Cl.
*B41M 5/50* (2006.01)

(52) U.S. Cl.
USPC ..... 503/227

(58) Field of Classification Search
USPC ..... 503/227; 428/32.64–32.68
See application file for complete search history.

(56) References Cited

U.S. PATENT DOCUMENTS

| | | | | |
|---|---|---|---|---|
| 5,143,782 | A | 9/1992 | Morishima et al. | |
| 5,143,783 | A * | 9/1992 | Shimizu et al. | 428/327 |
| 8,268,416 | B2 * | 9/2012 | Sawada | 428/32.64 |
| 2010/0330307 | A1 * | 12/2010 | Sawada | 428/32.67 |

FOREIGN PATENT DOCUMENTS

| | | | |
|---|---|---|---|
| JP | 03-065396 | A | 3/1991 |
| JP | 05162262 | A | 6/1993 |
| JP | 05177962 | A | 7/1993 |
| JP | 10-035122 | A | 2/1998 |
| JP | 10272853 | A | 10/1998 |
| JP | 11058989 | A | 3/1999 |
| JP | 2008105371 | A | 5/2008 |

OTHER PUBLICATIONS

Office Action from Japanese Application No. 2009-023969, dated Dec. 21, 2010.

* cited by examiner

*Primary Examiner* — Bruce H Hess
(74) *Attorney, Agent, or Firm* — Lerner, David, Littenberg, Krumholz & Mentlik, LLP

(57) ABSTRACT

A thermal transfer sheet includes a thermal transfer dye layer containing a dye on one surface of a base material sheet and a heat-resistant lubricating layer on the other surface, wherein the heat-resistant lubricating layer contains a binder, spherical particles protruding from a surface of the heat-resistant lubricating layer, and tabular particles having an average particle diameter larger than or equal to the average particle diameter of the spherical particles, and the tabular particles have a specific surface area of 5 m2/g or more and an average particle diameter of 10 μm or less.

7 Claims, 5 Drawing Sheets

THERMAL TRANSFER SHEET

CROSS-REFERENCE TO RELATED APPLICATION

The present application claims priority from Japanese Patent Application No. JP 2009-023969 filed in the Japanese Patent Office on Feb. 4, 2009, the entire content of which is incorporated herein by reference.

BACKGROUND OF THE INVENTION

1. Field of the Invention

The present invention relates to a thermal transfer sheet. In particular, the present invention relates to a thermal transfer sheet, in which a binder and spherical particles are used for a heat-resistant lubricating layer.

2. Description of the Related Art

A thermal transfer system by using a sublimation dye transfers a large number of color dots to a transfer receiver through a very short time heating so as to reproduce a full color image based on the color dots of a plurality of colors.

In this thermal transfer system, a so-called sublimation thermal transfer sheet, in which a dye layer composed of a sublimation dye and a binder is disposed on one surface of a base material sheet, e.g., a polyester film, is used as a thermal transfer sheet.

In the thermal transfer system, a thermal transfer sheet is heated from the back with a thermal head in accordance with image information so as to transfer a dye contained in a dye layer to a transfer receiver (photographic paper) and, thereby, form an image.

At this time, regarding the thermal transfer sheet, it is desired that a surface on the side coming into contact with the thermal head stably exhibits low friction over low density image printing to high density image printing. In general, the thermal transfer sheet is provided with a heat-resistant lubricating layer on the surface opposite to the surface, on which the dye layer is disposed, in order to prevent fusion with the thermal head and give smooth running smoothness.

Incidentally, in image printing on the photographic paper by using a thermal transfer sheet, heat is applied to the heat-resistant lubricating layer from the thermal head and, thereby, a dye in the dye layer on the opposite surface is transferred to the photographic paper. The color formation density is proportionate to an amount of heat, and the surface temperature of the thermal head changes by a few hundreds of degrees, correspondingly. Consequently, when the thermal transfer sheet moves on the thermal head, the friction coefficient between the thermal head and the heat-resistant lubricating layer changes easily because of the temperature change. If the friction coefficient between the thermal head and the heat-resistant lubricating layer changes, movement of the thermal transfer sheet at a constant speed becomes difficult and, thereby, it is difficult to obtain a sharp image.

For example, in the case where the friction coefficient is large, movement of the thermal transfer sheet becomes slow temporarily, and the density of merely that portion may become high. That is, so-called sticking (linear variations in image printing) may occur.

In order to prevent this sticking, it is desirable that the friction coefficient is reduced. As for lubricants to reduce the friction coefficient, phosphate esters and fatty acid esters have been used previously, and the phosphate esters and the fatty acid esters have been contained in the heat-resistant lubricating layers (refer to Japanese Unexamined Patent Application Publication No. 10-35122, for example).

Furthermore, regarding the thermal transfer sheet, spherical particles protruding from a heat-resistant lubricating layer surface are added as a filler for the heat-resistant lubricating layer. In the case where unevenness is provided on a surface of the heat-resistant lubricating layer by the spherical particles, the contact area of the thermal transfer sheet and the thermal head is reduced and the sliding on the thermal head is improved.

However, the phosphate esters and the fatty acid esters, which are used frequently in general, are volatilized or decomposed by heat from the thermal head so as to stain the thermal head. If image printing is further conducted repeatedly with this stained thermal head, adhered materials are baked on the thermal head surface. As a result, variations in image printing and the like may occur in the image printing.

Moreover, if image printing is repeated, a paper powder of photographic paper may be accumulated on the thermal head and, as a result, variations in image printing and the like may occur in the image printing.

Methods for solving them include a method, in which a surface of the thermal head is polished by using an inorganic filler or an organic filler.

In the case where abrasives are used, the surface of the thermal head can be cleaned. However, the thermal head in itself is polished and, therefore, an image in image printing may be affected. In addition, in the case where the abrasives are used, an increase in friction occurs and a load to a printer increases.

On the other hand, in consideration of these problems, a method has been proposed, in which spherical particles protruding from a surface of a heat-resistant lubricating layer and fine particles having particle diameters smaller than those of the spherical particles are included in the heat-resistant lubricating layer of a thermal transfer sheet (refer to Japanese Unexamined Patent Application Publication No. 03-65396, for example).

It is possible to conduct image printing while the friction of a thermal transfer sheet is maintained at a low level and a thermal head is cleaned, by using this method.

Japanese Unexamined Patent Application Publication No. 03-65396 describes that the particle diameter of the smaller particles is preferably 0.01 to 0.1 μm. However, in many cases, particles having such small particle diameters have high hardness and, furthermore, if the particle diameter is made too small, the contact surface area with the thermal head increases, so that the surface of the thermal head may be damaged.

SUMMARY OF THE INVENTION

The present inventor has recognized the above-described circumstances and, therefore, it is desirable to provide a thermal transfer sheet capable of realizing a low friction coefficient in the range of heating temperature through the use of a heating device. Furthermore, it is desirable to provide a thermal transfer sheet excellent in preservation stability without staining the heating device nor adversely affecting a thermal transfer dye layer.

A thermal transfer sheet according to an embodiment of the present invention includes a thermal transfer dye layer containing a dye on one surface of a base material sheet and a heat-resistant lubricating layer on the other surface, wherein the heat-resistant lubricating layer contains a binder, spherical particles protruding from a surface of the heat-resistant lubricating layer, and tabular particles having an average particle diameter larger than or equal to the average particle diameter of the spherical particles, and the tabular particles have a specific surface area of 5 m2/g or more and an average particle diameter of 10 μm or less.

According to an embodiment of the present invention, a heat-resistant lubricating layer contains spherical particles protruding from the surface of the heat-resistant lubricating layer, and tabular particles having an average particle diameter larger than or equal to the average particle diameter of the spherical particles. Consequently, excellent lubricity is obtained and a function of cleaning a heating device is provided. Furthermore, according to an embodiment of the present invention, tabular particles are also contained. Therefore, there is not such a polishing power that shaves a protective layer of the heating device as compared with that in the case where nanoparticles having a large specific surface area are contained in the heat-resistant lubricating layer. Consequently, according to an embodiment of the present invention, a harmful influence on the heating device can be reduced. Moreover, according to an embodiment of the present invention, tabular particles do not protrude from the surface of the heat-resistant lubricating layer after the heat-resistant lubricating layer is formed, so that the dye layer is not adversely affected and excellent preservation stability is exhibited.

DESCRIPTION OF THE PREFERRED EMBODIMENTS

A thermal transfer sheet according to an embodiment of the present invention will be described below in detail with reference to the drawings. In this regard, explanations will be made in the following order.

Figure 1:
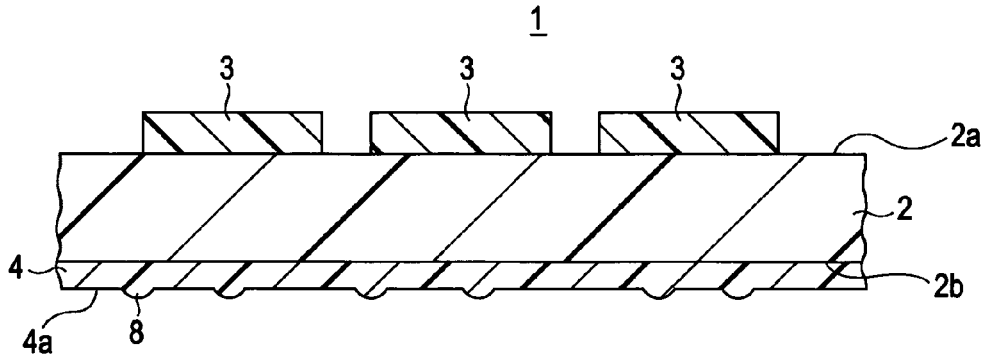
FIG. 1 is a schematic sectional view showing a configuration example of a thermal transfer sheet according to an embodiment of the present invention.

1. Base material sheet
2. Thermal transfer dye layer
3. Detection mark
4. Transfer pattern protective layer
5. Transfer pattern receiving layer
6. Heat-resistant lubricating layer
(1) Binder
(2) Spherical particles
(3) Tabular particles Configuration of Thermal Transfer Sheet In a thermal transfer sheet 1, as shown in FIG. 1, thermal transfer dye layers 3 are disposed on one surface 2*a* of a base material sheet 2 and, in addition, a heat-resistant lubricating layer 4 is disposed on a surface 2*b* opposite to the one surface 2*a*.

Base Material Sheet

Various base materials in the related art can be used for the base material sheet 2. For example, polyester films, polystyrene films, polypropylene films, polysulfone films, polycarbonate films, polyimide films, and aramid films can be used for the base material sheet 2. The thickness of this base material sheet 2 is determined at will. For example, the thickness is 1 to 30 μm, and preferably 2 to 10 μm.

Thermal Transfer Dye Layer

Figure 2:
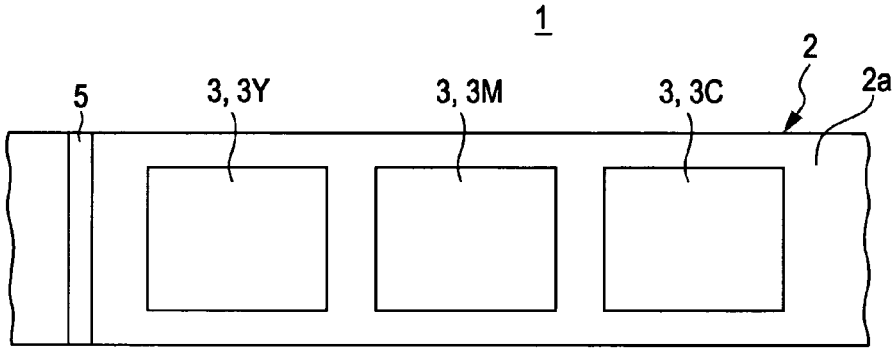
FIG. 2 is a schematic plan view showing a configuration example of the thermal transfer sheet.

The thermal transfer dye layers 3 are disposed on the one surface 2*a* of the base material sheet 2, that is, the surface on the side facing the photographic paper. In the case of monochrome, the thermal transfer dye layer 3 is disposed as a continuous layer on all over the base material sheet 2. In order to respond to a full color image, as shown in FIG. 2, in general, a yellow dye layer 3Y, a magenta dye layer 3M, and a cyan dye layer 3C are disposed separately and sequentially. In this regard, even in the case of monochrome, a plurality of thermal transfer dye layers 3 may be disposed separately and sequentially, as shown in FIG. 2.

The thermal transfer dye layers 3 (3Y, 3M, 3C) are formed from at least a binder and dyes of respective colors. Binders in the related art can be used as the binder. Examples thereof include organic solvents and water-soluble resins, e.g., water-soluble resins of cellulose base, acrylic acid base, starch base, and the like, acrylic resins, polyphenylene oxide, polysulfone, polyether sulfone, and acetyl cellulose. From the viewpoint of the recording sensitivity and the preservation stability of a transfer member, binders having heat distortion temperatures of 70° C. to 150° C. are excellent. Therefore, preferable examples of binders include polystyrenes, polyvinylbutyrals, polycarbonates, methacrylic resins, acrylonitrile-styrene copolymers, polyester resins, urethane resins, chlorinated polyethylenes, and chlorinated polypropylenes.

Any dye can be used. For example, as for the yellow dye, azo dyes, disazo dyes, methine dyes, pyridone-azo dyes, and the like and mixtures thereof can be used. As for the magenta dye, azo dyes, anthraquinone dyes, styryl dyes, heterocyclic azo dyes, and mixtures thereof can be used. As for the cyan dyes, indoaniline dyes, anthraquinone dyes, naphthoquinone dyes, heterocyclic azo dyes, and mixtures thereof can be used.

Detection Mark

Besides the thermal transfer dye layers 3 (3Y, 3M, 3C), detection marks 5 for detecting positions may be disposed on the one surface 2*a* of the base material sheet 2, as shown in FIG. 2. In the case where the detection mark 5 is disposed, for example, the detection mark 5, the yellow dye layer 3Y, the magenta dye layer 3M, and the cyan dye layer 3C are formed repeatedly.

Figure 3:
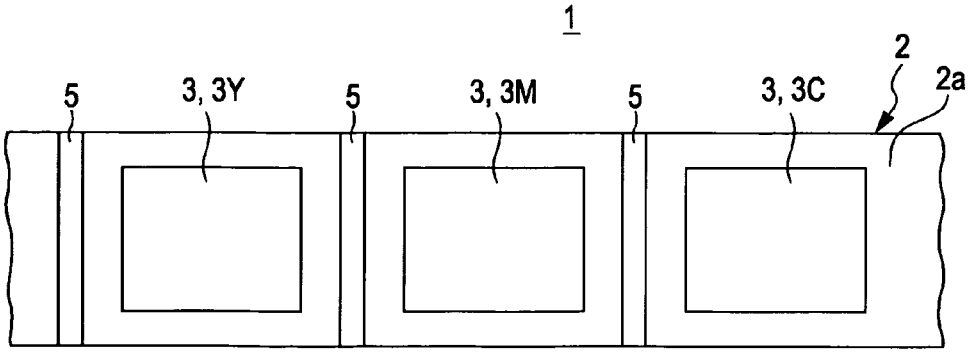
FIG. 3 is a schematic plan view showing an example of the thermal transfer sheet provided with detection marks between individual dye layers.

Here, the order of disposition of the yellow dye layer 3Y, the magenta dye layer 3M, and the cyan dye layer 3C is not necessarily the order of the yellow dye layer 3Y, the magenta dye layer 3M, and the cyan dye layer 3C, as shown in FIG. 2. The order of formation of the yellow dye layer 3Y, the magenta dye layer 3M, and the cyan dye layer 3C is changed appropriately. In this regard, a black dye layer may be added and four colors of yellow, magenta, cyan, and black may be repeated. In addition, as shown in FIG. 3, the detection marks 5 may be disposed between thermal transfer dye layers 3Y, 3M, and 3C of individual colors or between individual dye layers 3 in the case of monochrome.

Transfer Pattern Protective Layer

Figure 4:
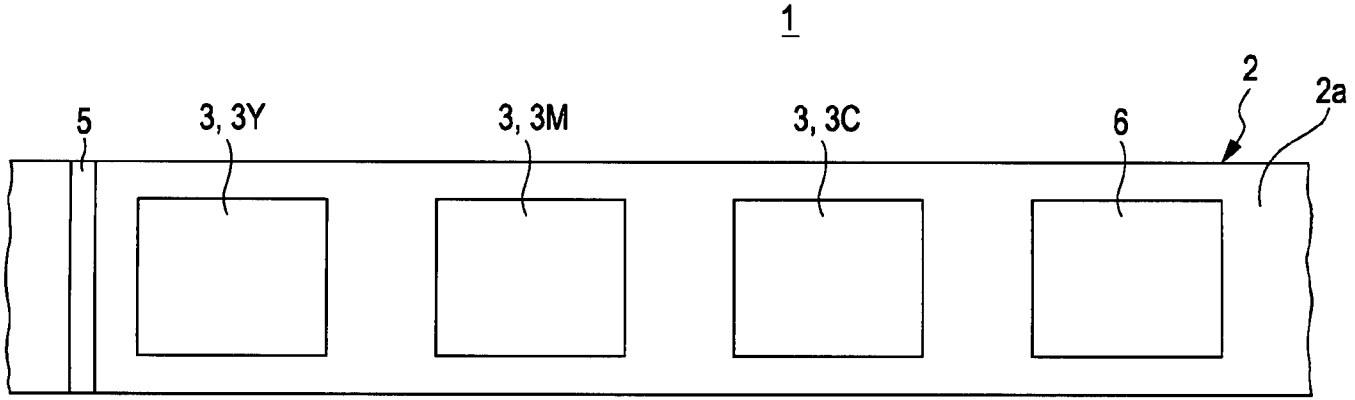
FIG. 4 is a schematic plan view showing an example of the thermal transfer sheet provided with a transfer pattern protective layer.

Moreover, as shown in FIG. 4, a transfer pattern protective layer 6 may be disposed on the one surface 2*a* of the base material sheet 2. The transfer pattern protective layer 6 is a transparent protective layer for protecting a print image surface by being transferred to the print image surface after the image printing. In the case of monochrome thermal transfer dye layers 3, a transfer pattern protective layer 6 is disposed appropriately. In the case where the thermal transfer dye layers 3Y, 3M, and 3C of individual colors are disposed, the thermal transfer dye layers 3Y, 3M, and 3C are assumed to be one group, and the transfer pattern protective layer 6 is disposed following the group composed of the dye layers 3Y, 3M, and 3C.

Transfer Pattern Receiving Layer

Figure 5:
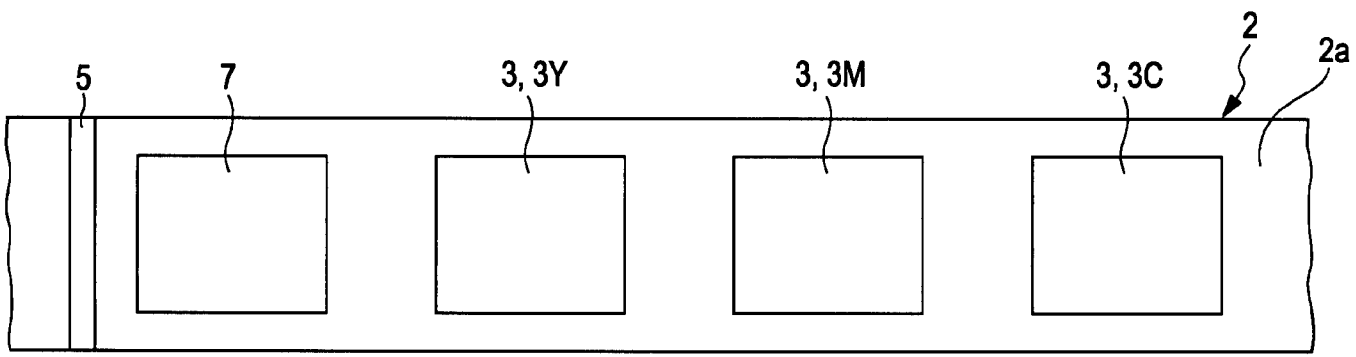
FIG. 5 is a schematic plan view showing an example of the thermal transfer sheet provided with a transfer pattern receiving layer.

Alternatively, as shown in FIG. 5, a transfer pattern receiving layer 7 may be disposed on the one surface 2*a* of the base material sheet 2. The transfer pattern receiving layer 7 is a layer, which is transferred to a normal paper surface prior to transfer of the thermal transfer dye layers 3 (3Y, 3M, 3C) and which receives and holds the dye. In the case of monochrome dye layers 3, the transfer pattern receiving layer 7 is disposed appropriately. In the case of the thermal transfer dye layers 3Y, 3M, and 3C, the transfer pattern receiving layer 7 is disposed toward the front of the group of dye layers 3Y, 3M, and 3C.

Heat-Resistant Lubricating Layer

On the other hand, the heat-resistant lubricating layer 4 for reducing friction against a thermal head is disposed on the other surface 2*b* on the opposite side of the surface 2*a*, on which the thermal transfer dye layers 3 and the like are disposed, of the base material sheet 2, because the thermal transfer sheet 1 runs while being in contact with the heating device, e.g., the thermal head.

Figure 6:
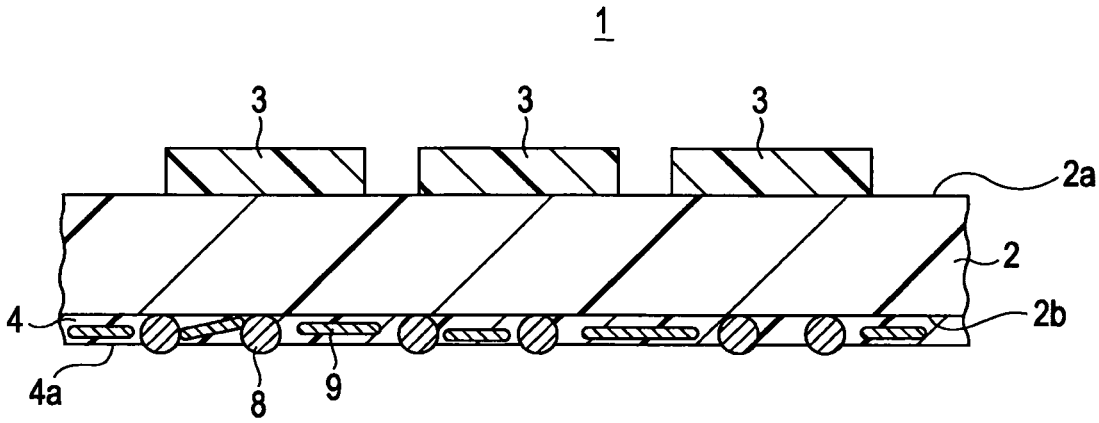
FIG. 6 is a schematic sectional view showing a state in which spherical particles and tabular particles are contained in a heat-resistant lubricating layer.
Figure 7:
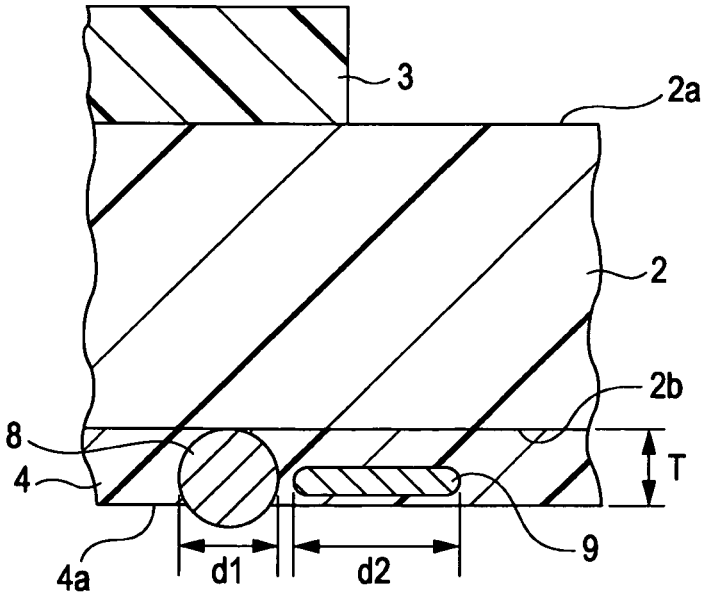
FIG. 7 is a schematic partial sectional view showing a state in which spherical particles and tabular particles are contained in a heat-resistant lubricating layer.
Figure 8:
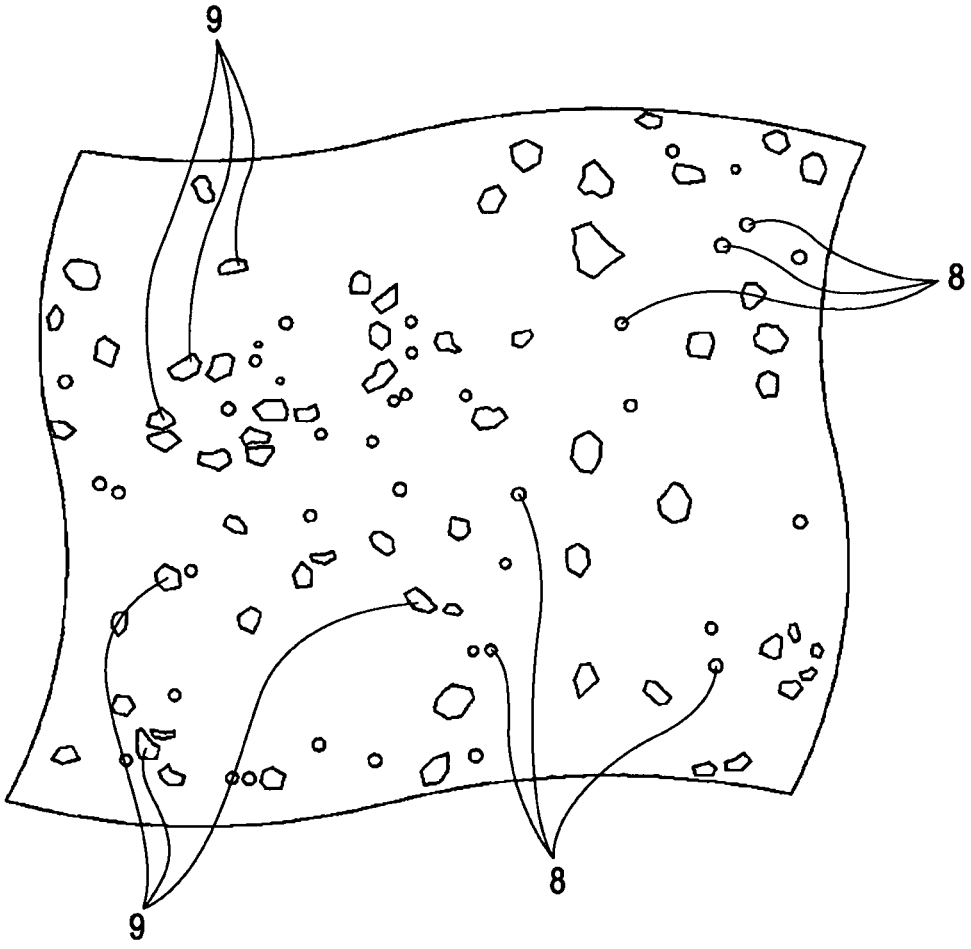
FIG. 8 is a schematic plan view of a heat-resistant lubricating layer.

As shown in FIG. 6 and FIG. 7, this heat-resistant lubricating layer 4 is primarily contains a binder and further contains spherical particles 8 protruding from a surface 4*a* of the heat-resistant lubricating layer 4 and tabular particles 9 having an average particle diameter d2 larger than or equal to the average particle diameter d1 of the spherical particles 8. As shown in FIG. 8, in the heat-resistant lubricating layer 4, the spherical particles 8 and the tabular particles 9 are dispersed. The thickness T of this heat-resistant lubricating layer 4 is 0.2 μm to 3.0 μm, and preferably 0.4 μm to 1.0 μm.

Binder

Any binder in the related art can be used for the binder. For example, cellulose acetates, polyvinyl acetals, and acrylic resins can be used. Furthermore, the binder may be cross-linked with a polyisocyanate compound in consideration of the heat resistance, the stability, and the like.

As for the polyisocyanate compound to be used, any isocyanate compound having at least two isocyanate groups in the molecule can be used. For example, torylene diisocyanate, 4,4'-diphenylmethane diisocyanate, 4,4'-xylene diisocyanate, hexamethylene diisocyanate, 4,4'-methylenebis(cyclohexyl isocyanate), methylcyclohexane-2,4-diisocyanate, methylcyclohexane-2,6-diisocyanate, 1,3-di(methyl isocyanate) cyclohexane, isophorone diisocyanate, and trimethylhexamethylene diisocyanate can be used. Furthermore, adducts (polyisocyanate prepolymers) produced by a partial addition reaction of diisocyanate and polyol, for example, adducts produced by reacting torylene diisocyanate with trimethylol propane, can also be used.

Spherical Particles

As shown in FIG. 6 and FIG. 7, the spherical particles 8 contained in the heat-resistant lubricating layer 4 have an average particle diameter d1 larger than the thickness T of the heat-resistant lubricating layer 4 and a part of the spherical particle 8 protrudes from the surface 4*a* of the heat-resistant lubricating layer 4. Consequently, unevenness is formed on the surface 4*a* of the heat-resistant lubricating layer 4.

As for the spherical particles 8, inorganic fillers, e.g., silica, titanium oxide, zinc oxide, and carbon, and organic fillers, e.g., silicone resins, Teflon (registered trade mark) resins, and benzoguanamine resins, can be used. Among them, the silicone resins are preferable as the spherical particles 8. The average particle diameter d1 of the silicone resin is larger than the thickness T of the heat-resistant lubricating layer 4 and is preferably 0.5 μm to 5.0 μm. Likewise, the average particle diameters d1 of other inorganic filler and the organic filler are larger than the thickness T of the heat-resistant lubricating layer 4 and are preferably 0.5 μm to 5.0 μm. If the average particle diameter d1 of the spherical particles 8 is too small, protrusion from the heat-resistant lubricating layer 4 becomes difficult. If the average particle diameter d1 is too large, it becomes difficult to transfer the heat of the thermal head during image printing. In this regard, the average particle diameter d1 here refers to an average particle diameter measured with a particle size analyzer.

The average particle diameter d1 of the spherical particles 8 can be controlled as described below, for example. In a method, in which the spherical particles 8 are formed through polymerization in a solution, the average particle diameter d1 can be controlled by adjusting the temperature and the time of the polymerization. In a method, in which the spherical particles 8 are formed through shaping, the average particle diameter d1 can be controlled by adjusting the shaping condition in the shaping through discharge of a molten raw material from a nozzle or the like. Furthermore, there is a method, in which the spherical particles 8 having a desired average particle diameter d1 are selected through a sieve or the like, for example.

Since unevenness is formed on the surface 4*a* of the heat-resistant lubricating layer 4 by the spherical particles 8, the contact surface between the heat-resistant lubricating layer 4 and the thermal transfer dye layers 3 can be reduced even when the thermal transfer sheet 1 is rolled and preserved. In addition, since unevenness is formed on the surface 4*a*, the contact surface between the thermal transfer sheet 1 and the heating device, e.g., the thermal head, can be reduced and the sliding performance with respect to the heating device can be facilitated.

It is preferable that the content of the spherical particles 8 in the heat-resistant lubricating layer 4 is specified to be 2.0 percent by mass or less, and the amount of addition is adjusted appropriately in consideration of the thickness T of the heat-resistant lubricating layer 4, the content of the spherical particles 8, and the like. In the case where the amount of addition of the spherical particles 8 is specified to be 2.0 percent by mass or less, an occurrence of poor drying in film formation of the heat-resistant lubricating layer 4 can be prevented and an occurrence of blocking in the state of rolling of the thermal transfer sheet 1 can be prevented. Moreover, in the case where the amount of addition of the spherical particles 8 is specified to be 2.0 percent by mass or less, the friction against the heating device can be reduced without damaging the surface of the heating device, e.g., the thermal head, with the surface 4*a* of the heat-resistant lubricating layer 4.

Tabular Particles

The tabular particles 9 are present in the heat-resistant lubricating layer 4. As for the tabular particles 9, inorganic fillers, e.g., talc, clay, and mica, and organic fillers formed from polyethylene resins and the like can be used. Among them, talc having a low hardness is most preferable as the tabular particles 9 from the viewpoint of the hardness. It is preferable that the average particle diameter d2 of talc is larger than the average particle diameter of the spherical particles 8 because if the average particle diameter d2 is too small, the specific surface area increases and the polishing action is enhanced in the contact with the heating device, e.g., the thermal head. Preferably, 1.0 to 10.0 μm is employed as the average particle diameter d2 of the talc. If the average particle diameter d2 of the talc is too large, dispersion of the talc into a paint of the heat-resistant lubricating layer 4 becomes difficult and settlement may occur. Furthermore, if the average particle diameter d2 of the talc becomes too large, the specific surface area decreases and a sufficient cleaning effect is not obtained. Therefore, the specific surface area of the tabular particles 9 is specified to be 5 m2/g or more. Regarding the other inorganic fillers and organic fillers as well, the average particle diameter is larger than or equal to the average particle diameter d1 of the spherical particles 8, the specific surface area is 5 m2/g or more and, in addition, the average particle diameter is 10 μm or less. The talc can be adjusted to have a desired average particle diameter through pulverization. In this regard, the average particle diameter d2 here refers to an average particle diameter (D50) measured by a laser diffraction method.

It is preferable that the content of the tabular particles 9 in the heat-resistant lubricating layer 4 is specified to be 2.0 percent by mass or less, and the amount of addition is adjusted appropriately in consideration of the thickness T of the heat-resistant lubricating layer 4, the content of the spherical particles 8, and the like. In the case where the amount of addition of the tabular particles 9 is specified to be 2.0 percent by mass or less, settlement in the paint of the heat-resistant lubricating layer 4 does not occur, coating is prevented from becoming difficult, and an increase in friction can be prevented.

In the thermal transfer sheet 1, the tabular particles 9 are contained in the heat-resistant lubricating layer 4. Consequently, it is not necessary to increase the content of the spherical particles 8 protruding from the surface 4*a* of the heat-resistant lubricating layer 4, and the friction can be reduced without damaging the heating device, e.g., the thermal head. In addition, in the case where the talc having a low hardness is used as the tabular particles 9, removal of baked adherents from the thermal head can be achieved without an occurrence of damage to the thermal head surface.

Furthermore, in the case where the talc is used as the tabular particles 9, when the base material sheet 2 is coated with a heat-resistant lubricating layer paint, the amount of charge is small, no static electricity is generated, and coating is conducted easily. Moreover, since the spherical particles 8 and the tabular particles 9 are used in the thermal transfer sheet 1, the particle diameter increases and the surface area decreases, as compared with those in the case where fine particles, e.g., silica or titanium oxide, is used instead of the tabular particles 9. Consequently, an organic material (phosphoric acid or the like) having an active group, for example, a lubricant or the like contained in the heat-resistant lubricating layer 4, is not adsorbed to the surfaces of inorganic particles. Therefore, it can be prevented that the intrinsic function of the organic material is not delivered.

In addition, the heat-resistant lubricating layer 4 may contain various lubricants besides the spherical particles 8 and the tabular particles 9. Examples of lubricants include polyglycerin fatty acid esters, phosphate esters, fatty acid esters, and fatty acid amides. Most of all, phosphate esters are used especially preferably.

In the case where a high-melting point lubricant is used, even when the thermal transfer sheet 1 is rolled and is preserved in the state in which the thermal transfer dye layers 3 and the heat-resistant lubricating layer 4 are stacked while facing each other, the dyes are not eluted from the thermal transfer dye layers 3 (3Y, 3M, 3C). Therefore, excellent preservation stability is exhibited and there is an advantage.

Furthermore, in the case where the lubricant exhibiting low volatility and being hard to decompose is used, even when preservation after rolling is conducted in a high-temperature environment, the dyes are not moved into the heat-resistant lubricating layer 4, so that a reduction in density in the image printing, an occurrence of image printing variations, and the like can be prevented, and staining of the thermal head can be prevented.

Regarding the thermal transfer sheet 1 having the above-described configuration, the thermal transfer dye layers 3 (3Y, 3M, 3C) are formed by applying a dye layer paint, in which a dye of each color, a binder, and the like are mixed in an organic solvent, to the one surface 2*a* of the base material sheet 2 with a gravure coater or the like, followed by drying. Moreover, regarding the thermal transfer sheet 1, the heat-resistant lubricating layer 4 is formed by applying a heat-resistant lubricating layer paint, in which a binder, the spherical particles 8, the tabular particles 9, and a lubricant, as necessary, are mixed in a solvent, to the other surface 2*b* of the base material sheet 2 with a gravure coater or the like, followed by drying. Consequently, in the resulting thermal transfer sheet 1, the thermal transfer dye layers 3 (3Y, 3M, 3C) are disposed on the one surface 2*a* of the base material sheet 2, and the heat-resistant lubricating layer 4 is disposed on the other surface 2*b*. In this regard, as described above, the detection mark 5, the transfer pattern protective layer 6, and the transfer pattern receiving layer 7 may be disposed appropriately.

In the thus obtained thermal transfer sheet 1, as shown in FIG. 1 and FIG. 6, the spherical particles 8 and the tabular particles 9 are dispersed in the heat-resistant lubricating layer 4, a part of the spherical particle 8 is protruded from the surface 4*a*, and the tabular particle 9 is present in the heat-resistant lubricating layer 4. In this thermal transfer sheet 1, the spherical particles 8 and the tabular particles 9 may be present in the state of particles, and the spherical particle 8 and the spherical particle 8, the tabular particle 9 and the tabular particle 9, and the spherical particle 8 and the tabular particle 9 may be present in the coagulated state. In the case where the spherical particles 8 and the tabular particles 9 are present in the coagulated state, sizes may become larger than the average particle diameter (d1) of the above-described spherical particles 8 of 0.5 μm to 5.0 μm or become larger than the average particle diameter (d2) of the tabular particles 9 of 1.0 to 10.0 μm.

The above-described thermal transfer sheet 1 includes the spherical particles 8 having sizes protruding from the surface 4*a* of the heat-resistant lubricating layer 4 and the tabular particles 9 having an average particle diameter d2, which is larger than or equal to the average particle diameter d1 of the spherical particles 8 and which is 10 μm or less, and a specific surface area of 5 m2/g or more. Consequently, regarding the thermal transfer sheet 1, unevenness is formed on the surface 4*a* of the heat-resistant lubricating layer 4, the contact area with the heating device, e.g., the thermal head, is reduced, and the friction can be reduced in the range of the heating temperature of the heating device, e.g., the thermal head. Consequently, regarding this thermal transfer sheet 1, image printing can be conducted without an occurrence of linear variations in image printing.

Furthermore, in the thermal transfer sheet 1, the heat-resistant lubricating layer 4 contains not only the spherical particles 8, but also the tabular particles 9. Therefore, the surface of the heating device is not damaged as compared with that in the case where spherical particles of nanoparticles are contained. Moreover, adherents of a dye, a paper powder, and the like adhered to the surface of the thermal transfer sheet 1 can be removed, and the heating device can be cleaned. Consequently, the heat from the heating device is transferred to the thermal transfer sheet 1 appropriately, so that image printing with high quality can be conducted.

In addition, since unevenness is formed on the surface 4*a* of the heat-resistant lubricating layer 4, even when the thermal transfer sheet 1 is rolled and is preserved, movement of the dyes into the heat-resistant lubricating layer 4 can be prevented because the contact area with the thermal transfer dye layers 3 (3Y, 3M, 3C) is small. Consequently, regarding the thermal transfer sheet 1, the image printing density is not reduced, retransfer, in which the dye is transferred to the other thermal transfer dye layers 3 (3Y, 3M, 3C) in rerolling, can be prevented, and excellent dye preservation performance is exhibited.

EXAMPLES

Specific examples according to an embodiment of the present invention will be described below in detail with reference to experimental results. First, spherical particles and tabular particles used will be described.

Spherical Particles

Polymethylsilsesquioxane (trade name XC-99, produced by Toshiba Silicone Co., Ltd., silicone resin, average particle diameter 0.7 μm)

Tabular Particles

Talc 1 (trade name SG-95, produced by NIPPON TALC Co., Ltd., average particle diameter 2.5 μm, specific surface area 15.0 m2/g)

Talc 2 (trade name P-6, produced by NIPPON TALC Co., Ltd., average particle diameter 4.0 μm, specific surface area 10.5 m2/g)

Then the above-described particles are used, and a thermal transfer sheet was produced by the following technique.

Initially, a polyester film (trade name Lumirror, produced by Toray Industries, Ltd.) having a thickness of 6 μm was used as a base material sheet, and one surface thereof was coated with the ink paint, as described below, in such a way that the thickness became 1 μm after drying, followed by drying.

| Yellow ink | |
|---|---|
| Foron Yellow (produced by Sandoz K. K.) | 5.0 parts by weight |
| Polyvinyl butyral resin (trade name BX-1, produced by Sekisui Chemical Co., Ltd.) | 5.0 parts by weight |
| Methyl ethyl ketone | 45.0 parts by weight |
| Toluene | 45.0 parts by weight |
| **Magenta ink** | |
| Foron red | 2.5 parts by weight |
| Anthraquinone dye (trade name ESC451, produced by Sumitomo Chemical Co., Ltd.) | 2.5 parts by weight |
| Polyvinyl butyral resin (trade name BX-1, produced by Sekisui Chemical Co., Ltd.) | 5.0 parts by weight |
| Methyl ethyl ketone | 45.0 parts by weight |
| Toluene | 45.0 parts by weight |
| **Cyan ink** | |
| Foron Blue (produced by Sandoz K. K.) | 2.5 parts by weight |
| Indoaniline dye (structural formula is shown as Chemical formula 1 described below) | 2.5 parts by weight |

-continued

| | |
|---|---|
| Polyvinyl butyral resin (trade name BX-1, produced by Sekisui Chemical Co., Ltd.) | 5.0 parts by weight |
| Methyl ethyl ketone | 45.0 parts by weight |
| Toluene | 45.0 parts by weight |

(Chemical formula 1)

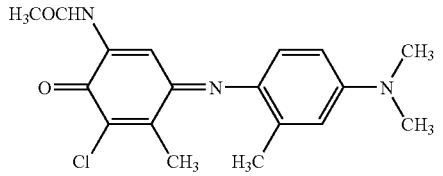

Next, a surface of the base material sheet opposite to the surface coated with the thermal transfer dye layers was coated with a heat-resistant lubricating layer paint composed of the following composition in such a way that the thickness became 0.5 μm after drying and, thereby, thermal transfer sheets of Example 1 to Example 4 were obtained.

Example 1 to Example 4

| Composition of heat-resistant lubricating layer | |
|---|---|
| Polyacetal resin (trade name DENKA BUTYRAL #3000K, produced by DENKI KAGAKU KOGYO K. K.) | 100 parts by weight |
| Polyisocyanate (trade name Coronate L, produced by NIPPON POLYURETHANE INDUSTRY CO., LTD., 45 percent by weight) | 20 parts by weight |
| Fatty acid ester (trade name EXCEPARL PE-TP, produced by Kao Corporation) | 20 parts by weight |
| Phosphate ester (trade name PHOSPHANOL RL-210, produced by TOHO Chemical Industry Co., Ltd.) | 25 parts by weight |
| Organic solvent (methyl ethyl ketone:toluene = 1:1) | 1,900 parts by weight |

The amounts of the spherical particles (polymethylsilsesquioxane) and the tabular particles (talc) are shown in Table 1 described below. In this regard, percent by mass in Table 1 indicates the proportion of the mass in the heat-resistant lubricating layer after formation.

TABLE 1

| | Lubricant | Mass in layer (%) | Parts by weight |
|---|---|---|---|
| Example 1 | polymethylsilsesquioxane (silicone resin) | 0.64 | 1 |
| | talc 1 | 0.64 | 1 |
| Example 2 | polymethylsilsesquioxane (silicone resin) | 1.28 | 2 |
| | talc 1 | 1.28 | 2 |
| Example 3 | polymethylsilsesquioxane (silicone resin) | 0.64 | 1 |
| | talc 2 | 0.64 | 1 |
| Example 4 | polymethylsilsesquioxane (silicone resin) | 1.28 | 2 |
| | talc 2 | 1.28 | 2 |

TABLE 1-continued

| | Lubricant | Mass in layer (%) | Parts by weight |
|---|---|---|---|
| Comparative example 1 | polymethylsilsesquioxane (silicone resin) | 0.64 | 1 |
| Comparative example 2 | talc 1 | 0.64 | 1 |
| Comparative example 3 | talc 2 | 0.64 | 1 |
| Comparative example 4 | polymethylsilsesquioxane (silicone resin) | 2.51 | 4 |
| | talc 1 | 0.62 | 1 |
| Comparative example 5 | polymethylsilsesquioxane (silicone resin) | 0.62 | 1 |
| | talc 1 | 2.51 | 4 |
| Comparative example 6 | polymethylsilsesquioxane (silicone resin) | 2.47 | 4 |
| | talc 1 | 2.47 | 4 |

Comparative Example 1 to Comparative Example 6

A surface of the base material sheet opposite to the surface coated with the thermal transfer dye layers was coated with a heat-resistant lubricating layer paint composed of the following composition in such a way that the thickness became 0.5 μm after drying in a manner similar to that in Example 1 to Example 4 and, thereby, thermal transfer sheets were obtained.

| Composition of heat-resistant lubricating layer | |
|---|---|
| Polyacetal resin (trade name DENKA BUTYRAL #3000K, produced by DENKI KAGAKU KOGYO K. K.) | 100 parts by weight |
| Polyisocyanate (trade name Coronate L, produced by NIPPON POLYURETHANE INDUSTRY CO., LTD., 45 percent by weight) | 20 parts by weight |
| Fatty acid ester (trade name EXCEPARL PE-TP, produced by Kao Corporation) | 20 parts by weight |
| Phosphate ester (trade name PHOSPHANOL RL-210, produced by TOHO Chemical Industry Co., Ltd.) | 25 parts by weight |
| Organic solvent (methyl ethyl ketone:toluene = 1:1) | 1,900 parts by weight |

The amounts of the spherical particles (silicone resin particles) and the tabular particles (talc) are shown in Table 1. In this regard, percent by mass in Table 1 indicates the proportion of the mass in the heat-resistant lubricating layer after formation.

Figure 9:
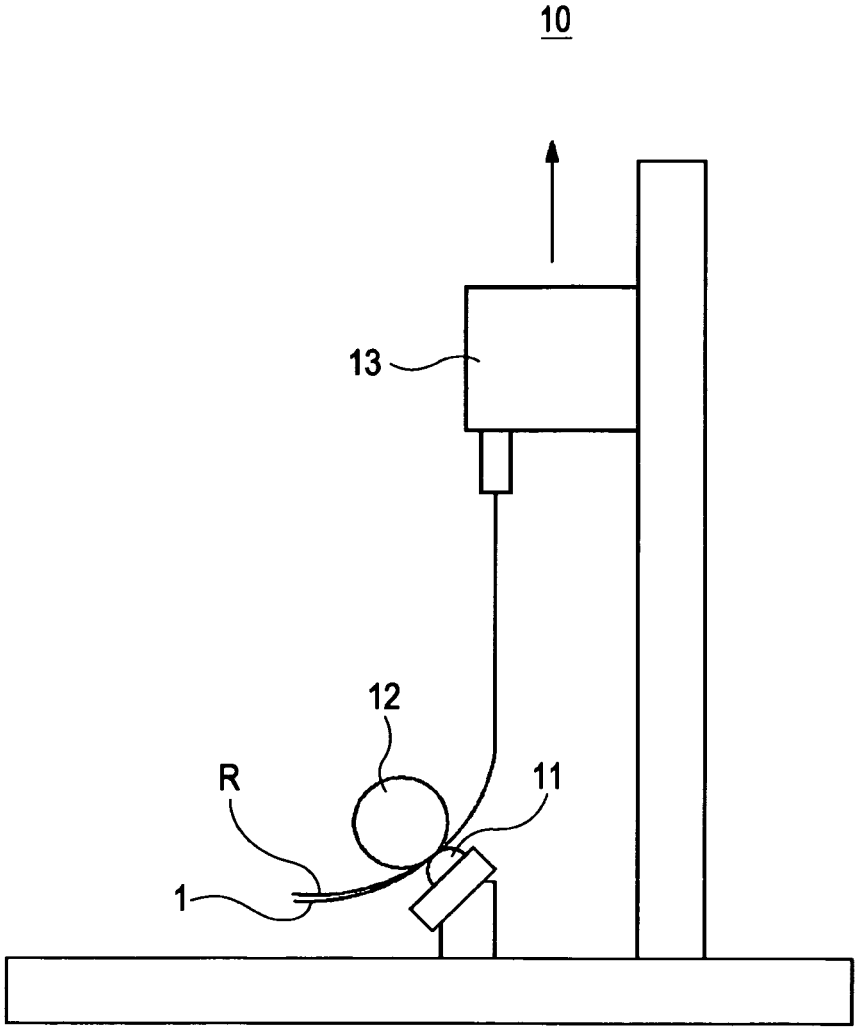
FIG. 9 is a schematic diagram showing the rough configuration of a friction measuring apparatus.

Regarding these thermal transfer sheets formed in Examples and Comparative examples, the friction coefficient, the running smoothness, the sticking, the dye preservation performance, and the thermal head staining resistance were measured. The friction coefficient was measured by using a friction measuring apparatus 10 shown in FIG. 9. Regarding this friction measuring apparatus 10, a thermal transfer sheet 1 and photographic paper R are sandwiched between a thermal head 11 and a platen roll 12, the thermal transfer sheet 1 and the photographic paper R are pulled up with a tension gauge 13 and, thereby, a tension is measured. The measurement condition is as described below.

Measurement Condition
Thermal transfer sheet feed speed: 450 mm/min
Signal Setting
Print pattern: 2 (Stair Step)
Original: 3 (48/672 lines, 14 steps)
Strobe division: 1
Strobe pulse width: 20.0 msec
Printing speed: 22.0 msec/1 line
Clock: 3 (4 MHz)
Head voltage: 18.0 V Furthermore, the running smoothness, the sticking, and the thermal head staining resistance were evaluated by using the following methods. The resulting thermal transfer sheet was mounted on a full color printer (trade name UP-D7000) produced by Sony Corporation, and gray-scale image printing (with a 16-step gradation) was conducted on photographic paper (trade name UPC7010 produced by Sony Corporation). The running smoothness (variations in image printing, wrinkle generation, and deviation in image printing) and the sticking were checked visually during image printing.

Regarding the running smoothness, a symbol ⊙ indicates that the result was good, and a symbol x indicates that wrinkles and the like were generated. Regarding the sticking, the symbol ⊙ indicates that no sticking occurred, and the symbol x indicates that sticking occurred.

Regarding the thermal head staining resistance, gray-scale image printing was repeated 20,000 times and, thereafter, the thermal head surface was observed with an optical microscope. The symbol ⊙ indicates that the result was good, and the symbol x indicates that adhered materials were observed and, therefore, staining occurred.

Moreover, regarding the dye preservation performance, the resulting two thermal transfer sheets (20 cm×20 cm) were stacked in such a way that the thermal transfer dye layers of one sheet faced the heat-resistant lubricating layer of the other sheet. The two sheets were sandwiched between two glass plates, a load was applied from above with a 5-kg weight, and preservation was conducted in an oven at 50° C. for 48 hours. The thermal transfer sheets before and after the preservation were mounted on the full color printer (trade name UP-D7000) produced by Sony Corporation, and gray-scale image printing (with a 16-step gradation) was conducted on photographic paper (trade name UPC7010 produced by Sony Corporation). A maximum density of each color was measured by a reflection density measurement with Macbeth densitometer (trade name TR-924). The dye preservation performance was evaluated on the basis of a calculation result of (maximum density after preservation/maximum density before preservation)×100(%). The results are shown in Table 2.

TABLE 2

| | Friction coefficient (min) | Friction coefficient (max) | Running smoothness | Sticking | Dye preservation performance (%) | Thermal head staining resistance |
|---|---|---|---|---|---|---|
| Example 1 | 0.17 | 0.21 | ⊙ | ⊙ | 99 | ⊙ |
| Example 2 | 0.18 | 0.23 | ⊙ | ⊙ | 98 | ⊙ |

TABLE 2-continued

| | Friction coefficient (min) | Friction coefficient (max) | Running smoothness | Sticking | Dye preservation performance (%) | Thermal head staining resistance |
|---|---|---|---|---|---|---|
| Example 3 | 0.17 | 0.21 | ⊙ | ⊙ | 99 | ⊙ |
| Example 4 | 0.17 | 0.22 | ⊙ | ⊙ | 97 | ⊙ |
| Comparative example 1 | 0.17 | 0.22 | ⊙ | ⊙ | 99 | X |
| Comparative example 2 | 0.25 | 0.31 | X | X | 88 | ⊙ |
| Comparative example 3 | 0.24 | 0.30 | X | X | 88 | ⊙ |
| Comparative example 4 | 0.15 | 0.19 | ⊙ | ⊙ | 97 | X |
| Comparative example 5 | 0.24 | 0.30 | X | X | 92 | ⊙ |
| Comparative example 6 | 0.24 | 0.30 | X | X | 80 | ⊙ |

As is clear from the results shown in Table 2, regarding all of Example 1 to Example 4, since the spherical particles and the tabular particles were contained, the friction against the thermal head was reduced, the running smoothness was good, the friction was low, sticking was not observed, and sharp images were obtained. Furthermore, regarding Example 1 to Example 4, the dye preservation performance of 90% or more was achieved and, therefore, there was substantially no problem in practical use. Moreover, as a result of observation of the thermal heads in Example 1 to Example 4, substantially no staining of thermal head surface occurred, there was substantially no trace of shaving of the thermal head surface, repetition of image printing was substantially not affected and, therefore, good images were obtained.

On the other hand, regarding Comparative example 1, merely the spherical particles of a silicone resin were contained. Consequently, the friction against the thermal head was reduced but, as a result of observation of the thermal heads, there were adhered materials on the thermal head surface, so that staining of thermal head occurred.

In Comparative example 2 and Comparative example 3, merely talc was contained and no silicone resin was contained, so that friction against the thermal head increased and the running smoothness was poor. Consequently, sticking was observed in Comparative example 2 and Comparative example 3. In addition, regarding the dye preservation performance, a significant reduction in the density after the preservation was observed and, therefore, a satisfactory result was not obtained.

In Comparative example 4, a film having a small friction coefficient was able to be obtained. However, the content of silicone exceeded 2.0 percent by weight and, as a result of observation of the thermal head, there were adhered materials on the thermal head surface, so that staining of thermal head occurred.

Regarding Comparative example 5, the content of the silicone resin was small and the content of the talc 1 was large. Therefore, the contact area between the surface of the heat-resistant lubricating layer and the thermal head increased, friction against the thermal head increased, so that the running smoothness was poor. Consequently, sticking was observed in Comparative example 5. In addition, regarding the dye preservation performance, a significant reduction in the density after the preservation was observed and, therefore, a satisfactory result was not obtained.

Regarding Comparative example 6, the contents of the silicone resin and the talc 1 were too large. Therefore, the contact area between the surface of the heat-resistant lubricating layer and the thermal head increased, friction increased, so that the running smoothness was poor. Consequently, sticking was observed in Comparative example 6. In addition, regarding the dye preservation performance, a significant reduction in the density after the preservation was observed and, therefore, a satisfactory result was not obtained.

As described above, it is clear that in the case where the heat-resistant lubricating layer contains spherical particles protruding from the surface of the heat-resistant lubricating layer and tabular particles having an average particle diameter larger than or equal to the average particle diameter of the spherical particles, the friction coefficient between the thermal head and the thermal transfer sheet can be reduced. Consequently, the thermal transfer sheet exhibits good running smoothness, and sticking can be prevented. Furthermore, regarding this thermal transfer sheet, good dye preservation performance is exhibited, the staining of the thermal head can be prevented without polishing a protective layer of the thermal head and, therefore, a good image can be obtained.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer sheet comprising:

a thermal transfer dye layer containing a dye on one surface of a base material sheet; and a heat-resistant lubricating layer on the other surface, wherein the heat-resistant lubricating layer contains a binder, spherical particles protruding from a surface of the heat-resistant lubricating layer, and tabular particles having an average particle diameter larger than or equal to the average particle diameter of the spherical particles, and the tabular particles have a specific surface area of 5 m2/g or more.

2. The thermal transfer sheet according to claim 1, wherein the content of each of the spherical particles and the tabular particles is 2.0 percent by mass or less in the heat-resistant lubricating layer.

3. The thermal transfer sheet according to claim 1, wherein the spherical particles are polymethylsilsesquioxane and the tabular particles are talc.

4. The thermal transfer sheet according to claim 1, wherein the heat-resistant lubricating layer comprises a fatty acid ester and a phosphate ester as lubricants.

5. The thermal transfer sheet according to claim 1, wherein the average particle diameter of the spherical particles is larger than a thickness of the heat-resistant lubricating layer such that a part of a respective spherical particle protrudes from the surface of the heat-resistant lubricating layer.

6. The thermal transfer sheet according to claim 5, wherein the thickness of the heat-resistant lubricating layer is 0.2 μm to 3.0 μm.

7. The thermal transfer sheet according to claim 5, wherein the thickness of the heat-resistant lubricating layer is 0.4 μm to 1.0 μm.

* * * * *